United States Patent [19]

Everett, Jr.

[11] Patent Number: 4,557,199

[45] Date of Patent: Dec. 10, 1985

[54] LIFTING STRUCTURE FOR RAILWAY TANK CAR

[75] Inventor: John E. Everett, Jr., Sharpsville, Pa.

[73] Assignee: General American Transportation Corporation, Chicago, Ill.

[21] Appl. No.: 516,683

[22] Filed: Jul. 25, 1983

[51] Int. Cl.[4] ..... B61K 5/00; B61D 5/00

[52] U.S. Cl. ..... 105/362; 105/462; 294/74; 294/67.4

[58] Field of Search ..... 105/362, 358, 355, 462; 104/32 R; 294/67 E, 67 DB, 74

[56] References Cited

U.S. PATENT DOCUMENTS

| | | | |
|---|---|---|---|
| 956,740 | 5/1910 | Smith . | |
| 1,341,787 | 6/1920 | Drayer | 105/462 |
| 4,223,612 | 9/1980 | Polley | 105/362 |
| 4,329,927 | 5/1982 | Minshull | 105/462 |
| 4,407,203 | 10/1983 | Harbin et al. | 105/362 |

*Primary Examiner*—Robert B. Reeves
*Assistant Examiner*—Dennis C. Rodgers
*Attorney, Agent, or Firm*—Emrich & Dithmar

[57] ABSTRACT

The tank of a railway tank car is supported adjacent to its opposite ends on two truck-mounted underframes, each underframe including a pair of body bolster plates disposed in a plane substantially perpendicular to the longitudinal axis of the tank and having an upper edge spaced well above the associated truck. Cover plates extend along the outer edges of the body bolster plates substantially perpendicular thereto and projecting upwardly above the upper edges thereof. Each body bolster plate has a rectangular notch in the upper edge thereof spaced closely adjacent to the outer surface of the tank. A lifting lug extends along each upper edge from the cover plate to the slabbing to close the upper end of the notch and define an opening to receive an associated lifting lug. Each lug has a broad inner end against the tank slabbing.

3 Claims, 4 Drawing Figures

LIFTING STRUCTURE FOR RAILWAY TANK CAR

BACKGROUND OF THE INVENTION

The present invention relates to railway tank cars and, in particular, to lifting structure therefor. The AAR Specifications for Tank Cars, standard S-234 of the Manual of Standards and Recommended Practices, requires that all tank cars be equipped with four lifting lugs in or around the bolster for the purpose of attaching hooks to lift the tank vertically. Typically, lifting devices on existing tank cars are placed along the bottom of the bolster near the jacking pad, i.e., adjacent to the bottommost and laterally outermost corners of the bolster. This location is at a maximum distance from the center of the tank. Therefore, the lifting moments are maximized during a lifting operation, which tends to put undue strain on the bolster and sometimes requires additional gusseting to distribute the forces transmitted to the tank shell. Furthermore, most prior lifting devices comprise additional attachments to the bolster.

SUMMARY OF THE INVENTION

It is a general object of this invention to provide a railway tank car and improved lifting structure therefor which avoids the disadvantages of prior devices while affording additional structural and operating advantages.

An important object of this invention is the provision of railway tank car lifting structure which minimizes the lifting moments.

In connection with the foregoing object, it is another object of this invention to provide a railway tank car lifting structure which is of relatively simple and economical construction, minimizing the need for additional gusseting.

Still another object of this invention is the provision of a railway tank car lifting structure of the type set forth, which is formed as a part of the tank body bolster.

It is yet another object of this invention to provide an improvement to a railway tank car which not only serves as a lifting structure, but also serves as a top termination for the tank bolster.

These and other objects of the invention are attained by providing a railway tank car comprising a generally cylindrical tank having a longitudinal axis, two trucks respectively supporting the opposte ends of the tank, two underframes respectively associated with the trucks and extending between the trucks and the bottom of the tank, each of the underframes including a bolster plate disposed along the underside of the tank in a plane substantially perpendicular to the longitudinal axis of the tank and having an upper edge extending laterally outwardly from the tank well above the bottom thereof, the bolster plate having an opening therethrough adjacent to the upper edge thereof and dimensioned and positioned for receiving therein an associated lifting hook for lifting the tank car.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
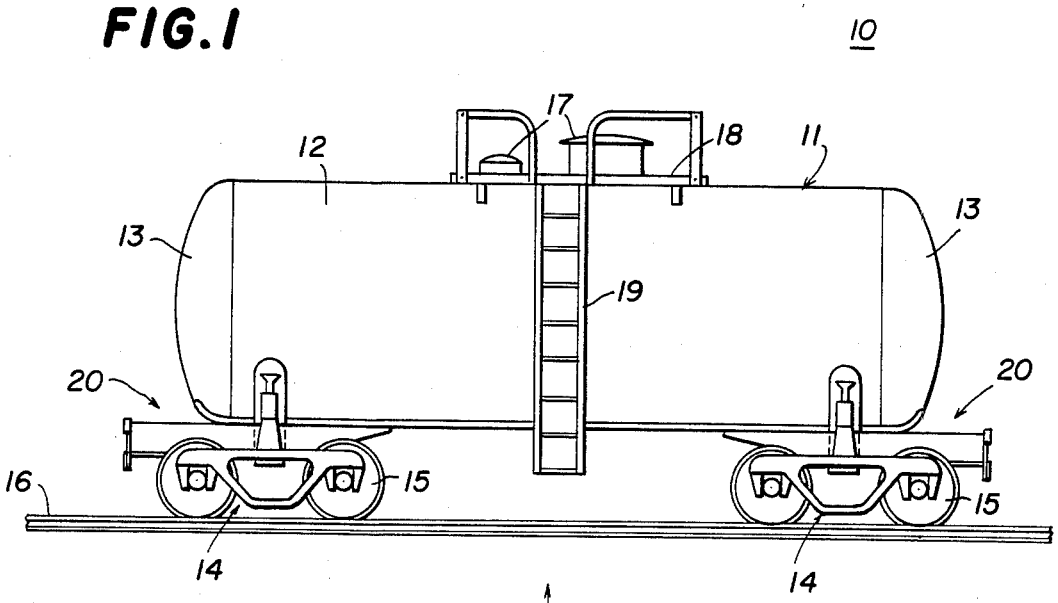
FIG. 1 is a side elevational view of a railway tank car incorporating lifting structure constructed in accordance with and embodying the features of the present invention.

Referring to FIG. 1 of the drawings, there is illustrated a railway tank car generally designated by the numeral 10, including a tank body 11 having a cylindrical tank shell 12 closed at the opposite ends thereof by curved end portions 13. The tank body 11 is supported respectively adjacent to the opposite ends thereof on two trucks 14, each comprising two pairs of wheels 15 adapted for rolling engagement with associated rails 16 in a well known manner. Mounted atop the tank body 11 are manways 17 surrounded by a platform 18, access to which is afforded by a ladder 19.

Figure 2:
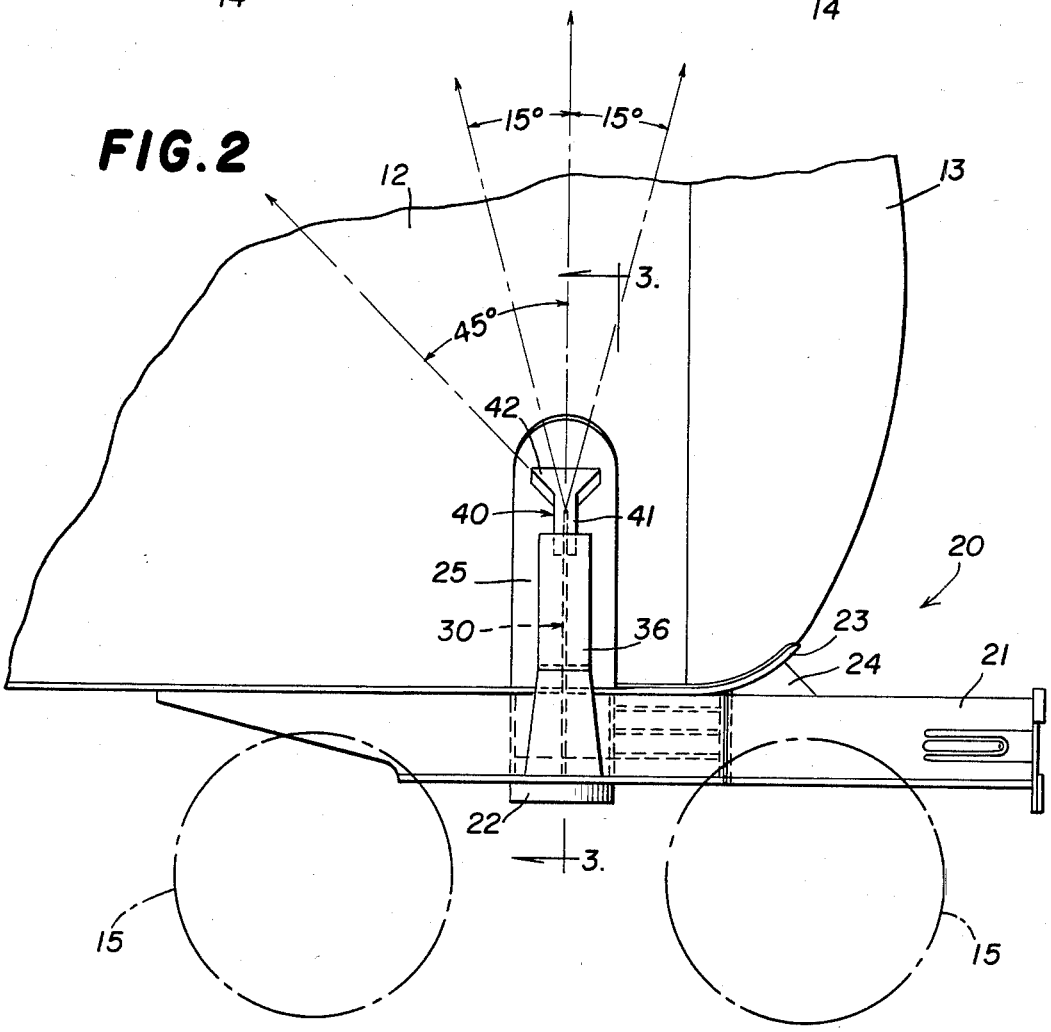
FIG. 2 is an enlarged, fragmentary view of the right-hand end of the tank car of FIG. 1, illustrating the lifting structure of the present invention.
Figure 3:
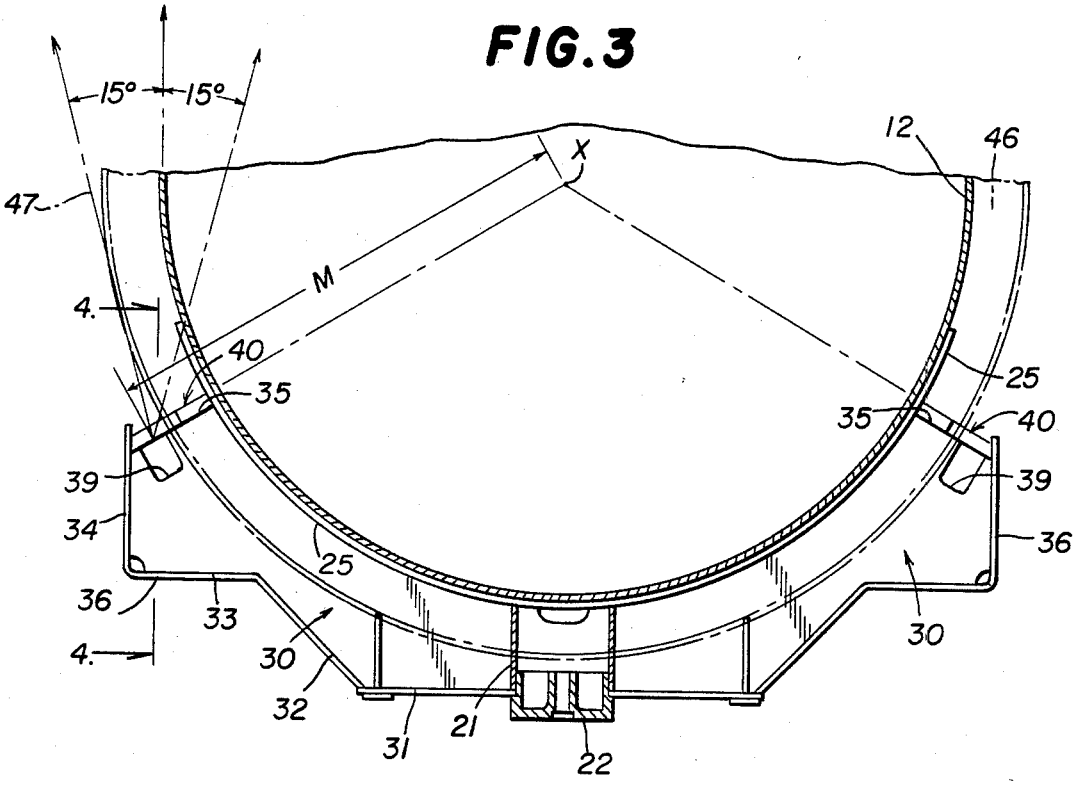
FIG. 3 is a fragmentary view in vertical section taken along the line 3—3 in FIG. 2.
Figure 4:
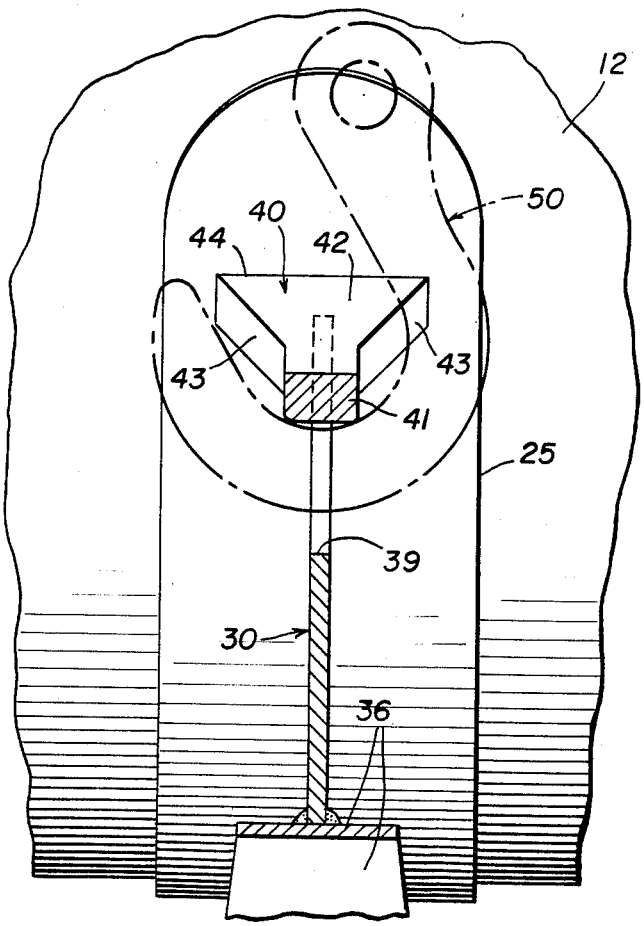
FIG. 4 is a further enlarged, fragmentary view in vertical section taken along the line 4—4 in FIG. 3 and illustrating cooperation with an associated lifting hook.

Referring also to FIGS. 2–4, there is mounted on each of the trucks 14, in supporting relationship with the associated end of the tank car 10, an underframe, generally designated by the numeral 20, the underframes 20 being substantially mirror images of each other, wherefore only one will be described in detail. Each underframe 20 includes an elongated draft sill 21, generally rectangular in transverse cross section, provided with a circular center plate 22 at the bottom thereof substantially intermediate the ends thereof. The draft sill 21 has mounted thereon suitable draft coupling structure (not shown) for connection to other railway cars. Carried by the draft sill 21 is a curved head slabbing 23 disposed in engagement with the underside of the tank body 11 at the junction between the cylindrical tank shell 12 and the adjacent end portion 13, the head slabbing 23 being supported on the draft sill 21 by suitable gusseting, as at 24. Also carried by the draft sill 21 is tank slabbing 25 which comprises an elongated arcuate strip extending circumferentially around the lower portion of the cylindrical tank shell 12 and fixedly secured to the outer surface thereof, as is best illustrated in FIGS. 2 and 3. All of the aforementioned structure of the underframe 20 is in accordance with standard railway tank car construction.

Each underframe 20 also includes a pair of bolster plates, each generally designated by the numeral 30. The bolster plates 30 are disposed substantially in a common vertical plane and are fixedly secured to the tank slabbing 25, as by welding, the bolster plates 30 extending substantially radially outwardly from the tank slabbing 25 and extending circumferentially from the draft sill 21 to a point near the adjacent upper end of the tank slabbing 25. The bottom of each bolster plate 30 is irregular and includes a substantially horizontal bottom edge 31, an upwardly and laterally outwardly inclined edge 32, a horizontal intermediate edge 33 and a vertical edge 34. Each bolster plate 30 is also provided with a top edge 35 which extends substantially radially of the cylindrical tank shell 12 from the tank slabbing 25 to the vertical edge 34, as can best be seen in FIG. 3. Fixedly secured to the bottom of each bolster plate 30 along the edges 31–34 thereof and extending substantially perpendicular thereto is a cover plate 36, the upper end of which projects a slight distance above the adjacent portion of the top edge 35.

It is a significant aspect of the present invention that there is formed in the top edge 35 of each bolster plate 30 a generally rectangular notch 39. Fixedly secured to each bolster plate 30 along the top edge 35 thereof is a lifting lug 40, which is preferably a metal member having a thickness substantially greater than the thickness of the bolster plate 30. More specifically, the lifting lug 40 has a relatively narrow rectangular end 41 which extends along the top edge 35 of the bolster plate 30 from the cover plate 36 toward the tank slabbing 25 and closes the upper end of the notch 39. Integral with the narrow end 41 is an enlarged end 42 which has sides 43 which diverge toward the tank slabbing 25 (see FIG. 4) and terminate in a bearing edge 44 disposed against the tank slabbing 25 and fixedly secured thereto, as by welding. Preferably, the narrow end 41 of the lifting lug 40 is also secured to the cover plate 36, as by welding.

An important feature of the present invention is that the notch 39 is positioned along the top edge 35 of the bolster plate 30 as close as possible to the tank slabbing 25. In the embodiment illustrated in FIG. 3, the notch 39 is spaced from the tank slabbing 25 a distance sufficient to accommodate therebetween a body of insulation 46 and an encompassing jacket 47, which is commonly used on tank cars. However, absent such insulation, the notch 39 would be placed immediately adjacent to the tank slabbing 25. Also, it will be appreciated that the lifting lug 40 cooperates with the notch 39 to define a rectangular opening for accommodating therein an associated lifting hook 50 (see FIG. 4) for lifting the tank car 10 in a known manner. In this regard, the narrow end 41 of the lifting lug 40 is dimensioned to fit easily into the open end of the lifting hook 50.

The present invention affords significant operating advantages. The placement of the notches 39 as close as possible to the outer surface of the cylindrical tank shell 12 serves also to locate them as close as possible to the longitudinal axis X of the cylindrical tank shell 12. This serves to minimize the length of the moment arm M, which is the radial distance from the axis X to the point at which the lifting hook 50 engages the lifting lug 40 during a lifting operation (see FIG. 3). Accordingly, the lifting moments are minimized, thereby minimizing the strain on the tank slabbing 25 of the tank shell 12. This minimizes or eliminates the need for additional gusseting at the junction between the bolster plate 30 and the tank slabbing 25.

Also, the lifting lug 40 serves as the top termination for the bolster plate 30 from the cover plate 36 to the tank slabbing 25. The flared enlarged end 42 of the lifting lug 40 serves to distribute stresses into the tank shell 12, thereby alleviating an undesirable weld condition.

The lifting lug 40 is designed not only to resist vertical loads, but also to resist horizontal components of loads when the tank car 10 is lifted in a loaded condition with the associated lifting cable (not shown) at any position around the lifting lug 40 within a 15° angle from the vertical, as indicated by the arrows in FIGS. 2 and 3. In actual lifting tests of a full size test specimen of the tank car 10, the car has been lifted with the cable at 45° to the vertical and toward the center of the tank, in accordance with AAR requirements, as indicated by the arrow in FIG. 2.

From the foregoing, it can be seen that there has been provided a tank car with an improved lifting structure which is of simple and economical construction while providing the necessary strength and minimizing the forces exerted on the tank shell in lifting.

I claim:

1. Lifting structure for a railway tank car including a generally cylindrical tank having a longitudinal axis, and trucks located adjacent the opposite ends of the tank, with each truck carrying a tank-supporting underframe which includes part-cylindrical slabbing extending circumferentially along the outer surface of the bottom of the tank, said lifting structure comprising: a bolster plate extending radially outwardly from the slabbing to the associated truck and having a top edge spaced well above the truck, an upwardly opening notch formed in said top edge of said bolster plate, a cover plate extending along the outer edge of said bolster plate substantially perpendicular to the plane thereof and projecting upwardly above said top edge thereof, and a lifting lug extending along said top edge from said cover plate to the slabbing and fixedly secured to said bolster plate and closing the open upper end of said notch, said lifting lug cooperating with said notch to define an opening dimensioned for receiving an associated lifting hook for lifting the tank car.

2. The lifting structure of claim 1, wherein said lifting lug is formed of metal and is welded to said top edge of said body bolster plate and to the slabbing and to said cover plate.

3. Lifting structure for a railway tank car including a generally cylindrical tank having a longitudinal axis, and trucks located adjacent to the opposite ends of the tank, with each truck carrying a tank-supporting underframe which includes part-cylindrical slabbing extending circumferentially along the outer surface of the bottom of the tank, said lifting structure comprising: a bolster plate extending radially outwardly from the slabbing to the associated truck and having a top edge spaced wall above the truck, a notch formed in said top edge of said bolster plate, and a lifting lug fixedly secured to said bolster plate, said lifting lug having a relatively narrow portion extending along said top edge and closing the upper end of said notch, said lifting lug having a generally triangular inner portion widening toward the slabbing for distributing the lifting forces imparted to the slabbing during a lifting operation, said lifting lug cooperating with said notch to define an opening dimensioned for receiving an associated lifting hook with said narrow portion of said lifting lug dimensioned to fit in the associated lifting hook for lifting the tank car.

* * * * *

UNITED STATES PATENT AND TRADEMARK OFFICE

CERTIFICATE OF CORRECTION

PATENT NO. : 4,557,199

DATED : December 10, 1985

INVENTOR(S) : John E. Everett, Jr.

It is certified that error appears in the above-identified patent and that said Letters Patent is hereby corrected as shown below:

Column 4, line 53, "wall" should be --well--.

Signed and Sealed this

*Twenty-fifth* Day of *March 1986*

[SEAL]

*Attest:*

DONALD J. QUIGG

*Attesting Officer*

*Commissioner of Patents and Trademarks*